US005303950A

United States Patent [19]

Rigal et al.

[11] Patent Number: 5,303,950

[45] Date of Patent: Apr. 19, 1994

[54] SAFETY BINDING FOR ALPINE SKIS

[75] Inventors: Jean-Pierre Rigal, La Balme de Sillingy; Alain Berthet, Albertville; Jean-Claude Brischoux, Annecy le Vieux, all of France

[73] Assignee: Salomon S.A., Annecy, France

[21] Appl. No.: 859,500

[22] PCT Filed: Dec. 13, 1990

[86] PCT No.: PCT/FR90/00910

§ 371 Date: Jun. 18, 1992

§ 102(e) Date: Jun. 18, 1992

[87] PCT Pub. No.: WO91/08808

PCT Pub. Date: Jun. 27, 1991

[30] Foreign Application Priority Data

Dec. 18, 1989 [FR] France ..... 89 16867
Jan. 23, 1990 [FR] France ..... 90 00830

[51] Int. Cl.[5] ..... A63C 5/075; A63C 9/085
[52] U.S. Cl. ..... 280/636; 280/607
[58] Field of Search ..... 280/607, 626, 629, 630, 280/634, 636

[56] References Cited

U.S. PATENT DOCUMENTS

| | | | |
|---|---|---|---|
| 3,806,144 | 4/1974 | Yans et al. | 280/636 |
| 4,294,460 | 10/1981 | Kirsch | 280/607 |
| 4,561,673 | 12/1985 | Pascal et al. | 280/629 |
| 4,586,727 | 5/1986 | Andrieu et al. | 280/607 |
| 4,657,279 | 4/1987 | Pascal et al. | 280/636 |
| 4,896,895 | 1/1990 | Bettosini | 280/607 |
| 4,911,463 | 3/1990 | Gertsch | 280/629 |
| 4,938,497 | 7/1990 | Goud | 280/625 |
| 4,984,816 | 1/1991 | Rullier | 280/636 X |
| 5,040,821 | 8/1991 | Berthet et al. | 280/636 X |
| 5,044,658 | 9/1991 | Challande et al. | 280/634 X |

FOREIGN PATENT DOCUMENTS

| | | | |
|---|---|---|---|
| 1578771 | 2/1971 | Fed. Rep. of Germany . | |
| 2030749 | 12/1971 | Fed. Rep. of Germany | 280/630 |
| 2333166 | 1/1975 | Fed. Rep. of Germany . | |
| 2832121 | 1/1980 | Fed. Rep. of Germany . | |
| 2905837 | 8/1980 | Fed. Rep. of Germany | 280/636 |
| 2517214 | 6/1983 | France . | |
| 2533832 | 4/1984 | France . | |
| 2537442 | 6/1984 | France . | |
| 2548031 | 1/1985 | France | 280/634 |
| 2615748 | 12/1988 | France . | |
| 2624752 | 6/1989 | France | 280/634 |
| 2625911 | 7/1989 | France . | |
| 2449459 | 9/1990 | France . | |
| WO83/03360 | 10/1983 | World Int. Prop. O. . | |
| 0003451 | 8/1985 | World Int. Prop. O. | 280/636 |

*Primary Examiner*—Brian L. Johnson
*Attorney, Agent, or Firm*—Sandler, Greenblum & Bernstein

[57] ABSTRACT

A safety binding for skis designed to hold the front end of a boot and to release the front end of the ski boot from the ski under a predeterminate force. The binding includes a quantity of shock-absorbing material positioned below and mounted to the base of the binding and above the upper surface of the ski for filtering vibrations transmitted by the ski to the ski boot and for absorbing stresses between the ski boot and the ski. The binding also includes a compensating mechanism that includes an arrangement for reducing the predeterminate biasing force of the retention element of the binding in response to a downward force exerted by the ski boot.

3 Claims, 6 Drawing Sheets

Fig- 10
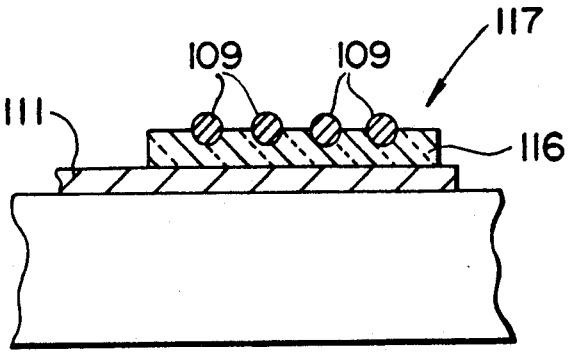
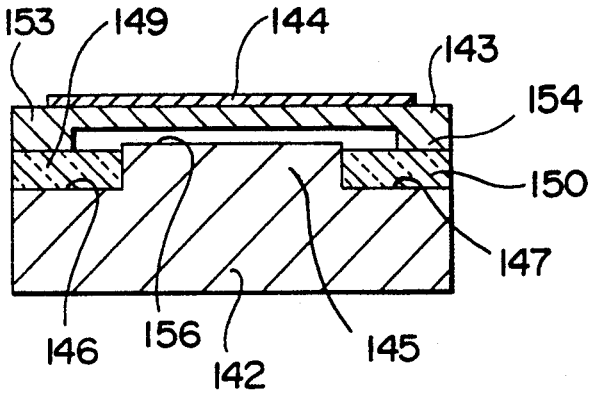
Fig- 11
Fig- 12
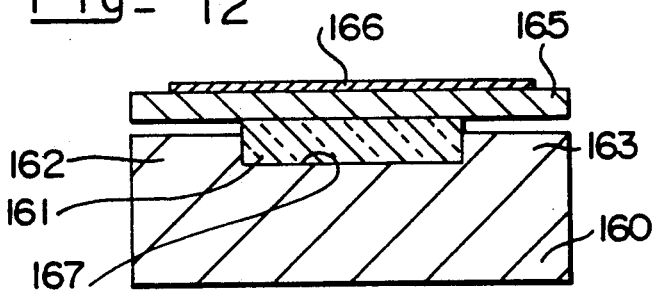
Fig- 13
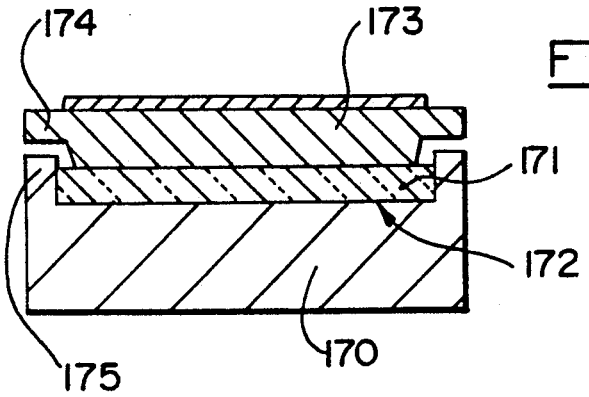

SAFETY BINDING FOR ALPINE SKIS

BACKGROUND OF THE INVENTION

1. Field of the Invention

The present invention is related to a safety binding for a ski, which is adapted to retain the front end of a boot on a ski, and to release the end of the boot when it exerts an excessive force on its binding.

More specifically, the invention is related to the contact plate, that is associated to the front retention element of the boot, and on which the sole of the boot rests.

2. Description of Background and Relevant Information

Support elements that are affixed to the ski or to the base of the binding are known. Generally, these elements are constituted by a base plate on which an anti-friction surface is affixed, most often a polytetrafluoroethylene plate. Such a support element has been described, for example, in French Patent Publication No. 2,533,832.

Support elements that comprise a base plate affixed to the ski and a laterally movable support plate are also known. This support plate, on which the sole rests, can be displaced laterally with the sole. In this case, during release of the boot, the friction is localized between the support plate and the base plate and not between the lower surface of the sole and the support of the boot on the ski.

French Patent Publication No. 2,449,459 describes such a support element, with a support plate that is laterally movable with the element that retains the front of the boot.

German Patent Publication No. 2,333,166 describes another embodiment, according to which the support plate is independent of the jaw, but is connected to the base plate of the support element by an elastic return device.

The support elements that are known have the disadvantage that all the vibrations, jolts or shocks to which the ski is subjected, along a vertical direction, are directly transmitted to the boot. The boot is in fact in direct support on the ski by the intermediary of elements that are non-deformable along a vertical direction.

These shocks and vibrations form a part of the information that the skier perceives by means of his skis, his boots and his bindings. It is on the basis of this information that the skier controls his movements to adjust his position or to execute a turn or to position his running edges, for example.

These shocks and these vibrations, if directly transmitted, are harmful because their amplitude is excessive with respect to the amount of other information that the skier receives. These shocks and these vibrations momentarily mask other information.

SUMMARY OF THE INVENTION

One of the objects of the invention is to propose a contact plate for a binding, and especially a front binding, that overcomes the aforementioned disadvantage by filtering the information that is transmitted to the skier via his ski and his boot in order to especially moderate information having excessive amplitude.

Another object of the invention is to propose a binding that is easy to implement.

Other objects and advantages of the invention will become more apparent upon reading the description that follows.

The ski binding, according to the invention, is adapted to retain the front end of a boot on a ski, and to release this end of the boot when it exerts excessive force on its binding. It comprises an element for retaining the end of the boot and also comprises a contact plate positioned between the boot and the ski, the front of the sole of the boot resting on the contact plate, the contact plate also having a support plate which is in contact with the sole of the boot.

The safety binding of the invention, additionally, has a layer of shock absorbing material positioned between the support plate and the upper surface of the ski in order to filter the vibrations transmitted by the ski to the boot, and at the same time, to maintain the conditions of contact and of transverse sliding of the boot with respect to the support plate.

BRIEF DESCRIPTION OF THE DRAWINGS

The invention will be better understood with reference to the description that follows, as well as to the annexed drawings that form an integral part of it.

FIG. 10 represents, in a side sectional view, a variation of the embodiment of the contact plate;

FIGS. 11–13 represent variations of the embodiment of the contact plate, adapted to special ski shapes;

DETAILED DESCRIPTION OF PREFERRED EMBODIMENTS

Figure 1:
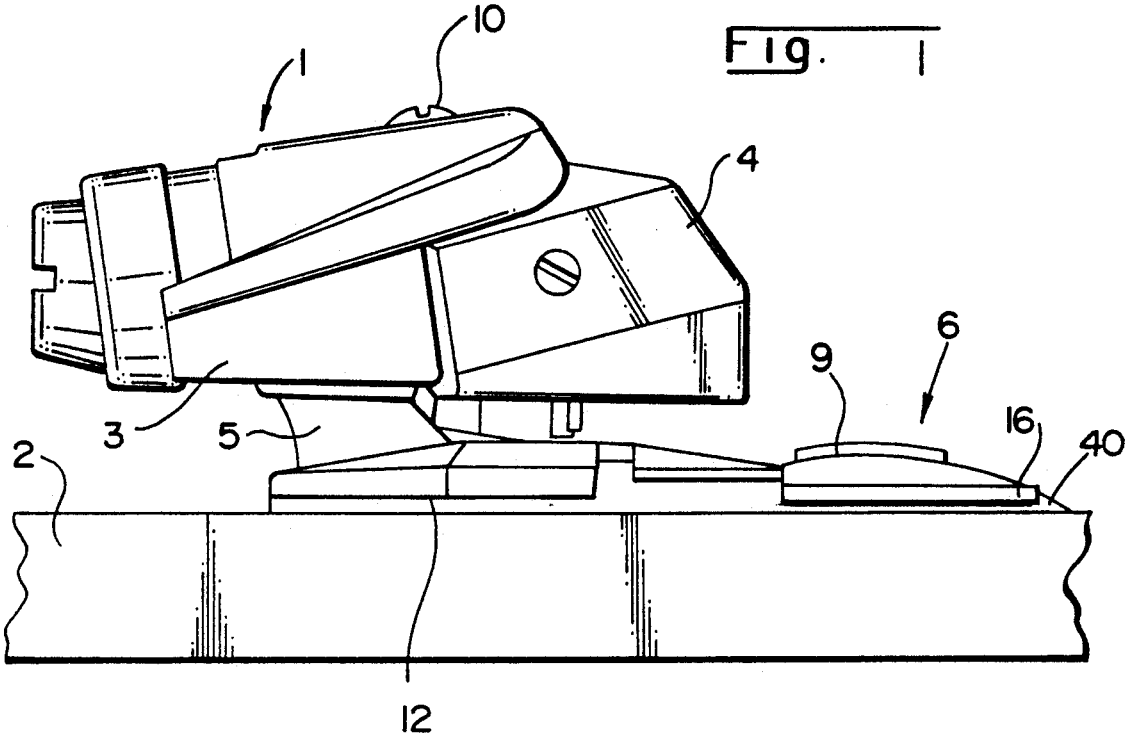
FIG. 1 represents a side view of a front binding equipped with a contact plate according to the invention.

FIG. 1 represents a safety binding 1 that is adapted to retain the front end of a boot on a ski 2. The front binding is of any appropriate type. The binding 1 represented in FIG. 1 has a body 3 that is rotationally mobile about a base 5, affixed to ski 2. The binding, moreover, comprises a jaw 4 that constitutes, with body 3, an integral assembly. In a known manner jaw 4 has means for retention of the front end of the boot, especially means ensuring the lateral and vertical retention in the upward direction of the boot.

Jaw 4 can be adjusted in height to be adapted to soles of different thicknesses by a known means, for example a vertical screw 10 that connects body 3 to base 5 and that adjusts the vertical position of the body. Naturally, any other appropriate means can be used.

Moreover, binding 1 has a contact plate 6, on which the front end of the sole of the boot rests.

In response to the lateral biases of the boot, binding 1 exerts a return force in opposition thereto. Beyond a predetermined bias, jaw 4 allows the front of the boot to escape, such boot then finding itself released.

The lateral release of the front of the boot is also accompanied with the sliding of the sole on the contact plate 6, along a transverse direction.

Figure 3:
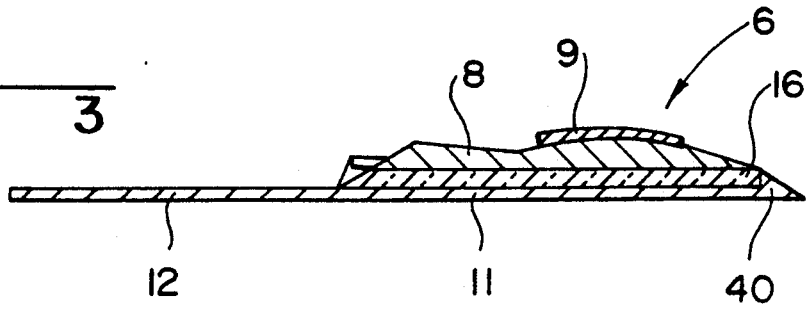
FIG. 3 is a side view, in a longitudinal section of the contact plate of FIG. 1.
Figure 4:
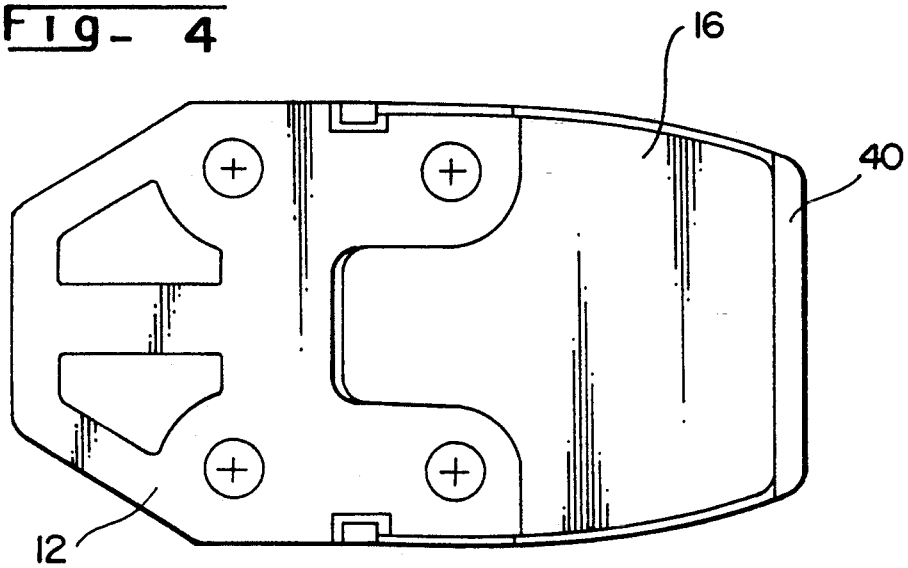
FIG. 4 is a top view of the contact plate of FIG. 1, without the upper support plate.

With reference to FIG. 3, contact plate 6 has, in its upper portion, a support plate 8. It is on this support plate that the sole rests. The support plate is sufficiently rigid to support the front of the boot without deformations, and it has, on its upper surface, in the contact zone of the boot, means to moderate the friction between the sole and the plate. For example, support plate 8 is equipped with a slide pad 9, in its contact zone with the sole of the boot. This slide pad 9 is, for example, constituted by a polytetrafluoroethylene plate adhered on the support plate 8.

Figure 2:
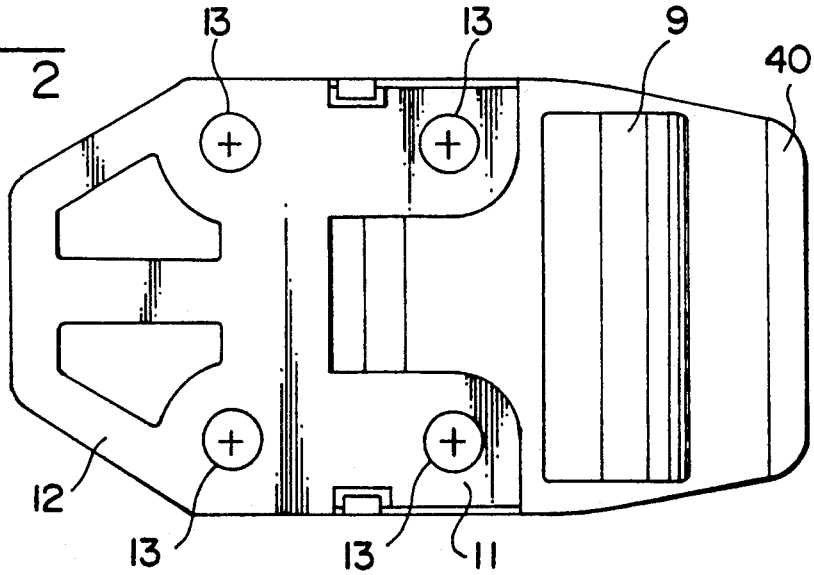
FIG. 2 represents a top view of the contact plate of FIG. 1.

Moreover, the contact plate 6 comprises, in its lower portion, beneath the support plate 8, a base plate 11 that is in support against the upper surface of the ski. Thus, as is represented in FIGS. 2 and 3, base plate 11 extends frontwardly by a portion 12 that is engaged beneath base 5 of the binding. The base plate 11 is thus maintained against the ski by means of screws that assemble base 5 to the ski. The openings for passage of the screws are visible at 13 in FIG. 2.

Between support plate 8 and base plate 11, contact plate 6 has a layer 16 of a shock absorbing material. In FIG. 3, layer 16 has a substantially constant thickness, in the absence of a boot, and extends substantially beneath the entire surface of the support plate 8. It is affixed at each of its surfaces, from one side to support plate 8, and from the other side to base plate 11, for example by adhesion (gluing) or by nesting in a housing of support plate 8 or base plate 11.

Preferably, in its rear portion, plate 11 has a projecting spoiler 40. This spoiler continuously extends the upper surface of support plate 8. Additionally, it constitutes a rear abutment for layer 16, and stops the rearward creep of this layer when it is compressed.

The material of layer 16 is chosen for its qualities of elasticity and mechanical shock absorption, so as to dampen the vibrations and shocks to which the ski is subjected, and which are transmitted to the boot.

This material is of any appropriate type, and could be, for example, a thermoplastic material whose shore hardness A is comprised between 10 and 95 for a thickness of 2–6 millimeters, and that has, moreover, qualities of elasticity, that is, of elastic return, and of shock absorption. The material could also be of a viscoelastic type. Also, the material can have progressive rigidity according to its compression, for example, due to its shape, or due to the material from which it is comprised. To this end, vertical recesses could be present, for example, in the central portion of layer 16.

Thus, the front of the boot is in support on support plate 8 by the intermediary of slide pad 9. The front of the sole rests on a rigid support and, in case of lateral release, the front slides with respect to this rigid support, or more specifically, slide pad 9 of this support. Thus, the conditions of contact and of sliding of the boot are not modified with respect to a traditional support element.

Conversely, layer 16 absorbs the shocks and vibrations originating from the ski. These shocks and vibrations thus reach support plate 8 and the boot with a moderated amplitude.

Figure 5:
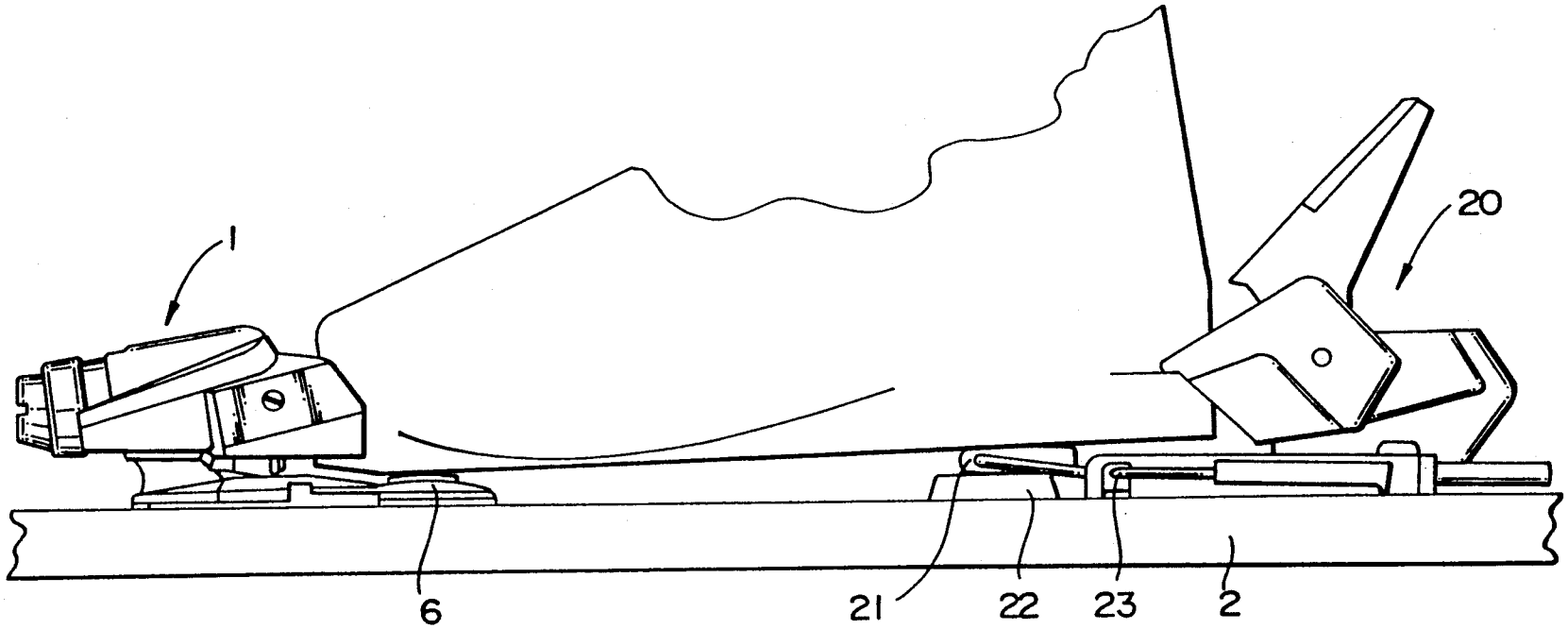
FIG. 5 is a general view showing a boot on a ski, and illustrates an advantageous application of the invention.

FIG. 5 represents, on one part of ski 2, binding 1 of FIG. 1, that is adapted to retain the front of the boot, as well as a rear binding element 20, that is adapted to retain the rear end of the boot.

The front binding element 1 has a contact plate 6 on which the front end of the boot rests. The rear end of the boot, insofar as it is concerned, is in support on a support surface 21, which, in the present case, is constituted of the upper surface of the brake of rear binding 20.

A layer of shock absorbing material 22 is inserted between the support surface 21 and the upper surface of ski 2. Preferably, the material used for layer 22 has greater stiffness than that used for the layer of shock absorbing material 16 of the front contact plate 6. Also, advantageously, support surface 21 of the boot is guided so as only to be displaced in the vertical plane and parallel to the longitudinal axis of the ski. The movement of support surface 21 is basically a translational movement along a vertical direction. In the example represented, surface 21 is journalled about rotational axis 23 of the arms of the brake. This journal counteracts any rocking motion of surface 21. In this manner, the skier perceives information from the front of his boot, said information being filtered and absorbed by layer 16 of the front contact plate 6. On the other hand, the lateral movements that he supplies, and that are transmitted by the boot to the ski, are basically transmitted by the heel of the boot, by layer 22 located beneath the rear support surface 21.

Indeed, it has been noted that the front portion of the foot is more sensitive in perceiving information originating from the snow. In contrast, the heel is the zone by which the skier moves his ski, undoubtedly due to its location in the axis of the tibia.

The shock absorption provided by layer 16 beneath the front of the sole is of a multidirectional type. Indeed, support plate 8 is not guided in any direction. It is, in a way, floating on layer 16.

In contrast, the shock absorption that is provided by layer 22 is mainly vertical by virtue of the guiding of support surface 21. The purely vertical movements of the heel in the direction of the ski are absorbed, but the lateral movements supplied by the skier, for example, at turns or in positioning of the running edges, are transmitted directly to the ski.

Figure 6:
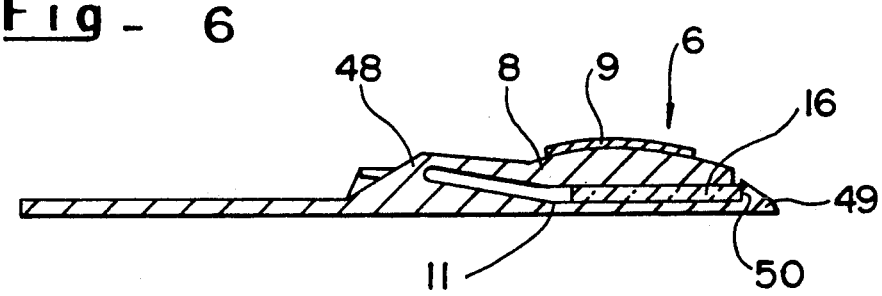
FIG. 6 represents, in a side, sectional view, a variation of the embodiment of the contact plate of FIG. 3.

In the variation of FIG. 6, base plate 11 and support plate 8 are connected to each other continuously towards the front by an elastically deformable zone 48, which constitutes an elastic hinge of sorts. As in the preceding case, the layer of shock absorbing material 16 is inserted between support plate 8 and base plate 11.

Additionally, base plate 11 extends rearwardly by a spoiler 49, which has a surface 50 oriented towards a layer 16. This surface 50 constitutes an abutment for the rear edge of the layer of shock absorbing material 16, an object of which is to limit its action during shearing, and to encourage its action during compression.

Figure 7:
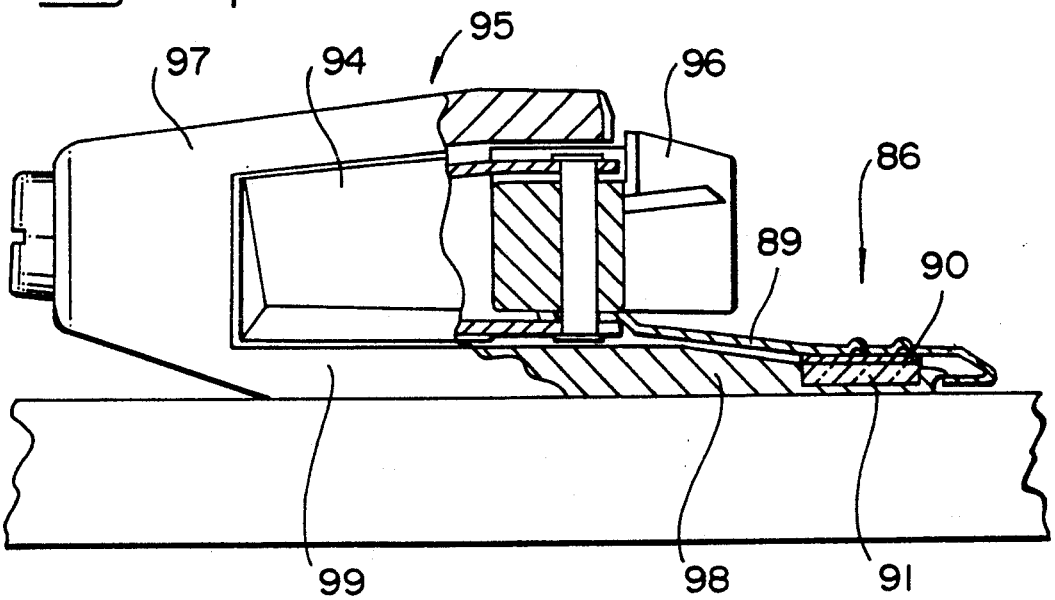
FIGS. 7–9 illustrate variations of the embodiment of the invention where the contact plate is mobile with the jaw of the binding.

FIG. 7 represents a binding 95, with a jaw 96, mobile with respect to a fixed body 97. For example, binding 95 has a construction similar to the binding described in French Patent Publication No. 2,625,911. Jaw 96 is connected to the body by arms 94 and it is guided by the arms 94 in its lateral movement Support plate 89 is connected in an affixed manner to jaw 96, and it accompanies jaw 96 in its lateral movement. Base plate 98 is fixed, being merged with base 99 of body 97 and extends such base rearwardly.

The layer of shock absorbing material 91 is embedded in a housing 99 of base plate 98 and, moreover, such layer 91 is overhung with a slide pad 90.

Figure 8:
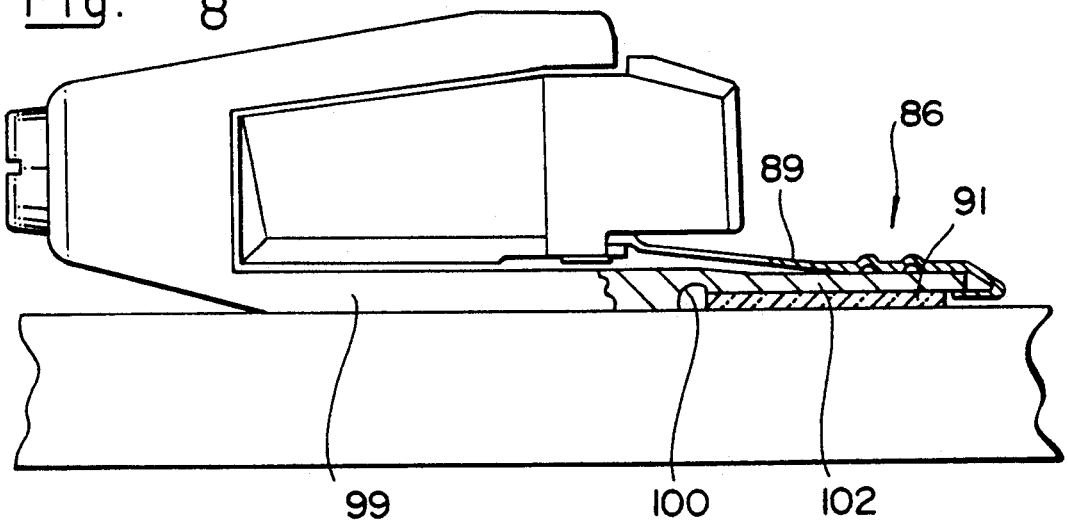

FIG. 8 represents a variation of the embodiment, according to which layer 91 is inserted between the upper surface of the ski and base plate 102. Thus, base plate 102 is slightly raised with respect to the upper surface of the ski. A recess or cut-out 100 is located between base plate 102 and base 99 of the binding so as to enable a movement of the base plate 102 with respect to the ski, along a vertical direction.

Figure 9:
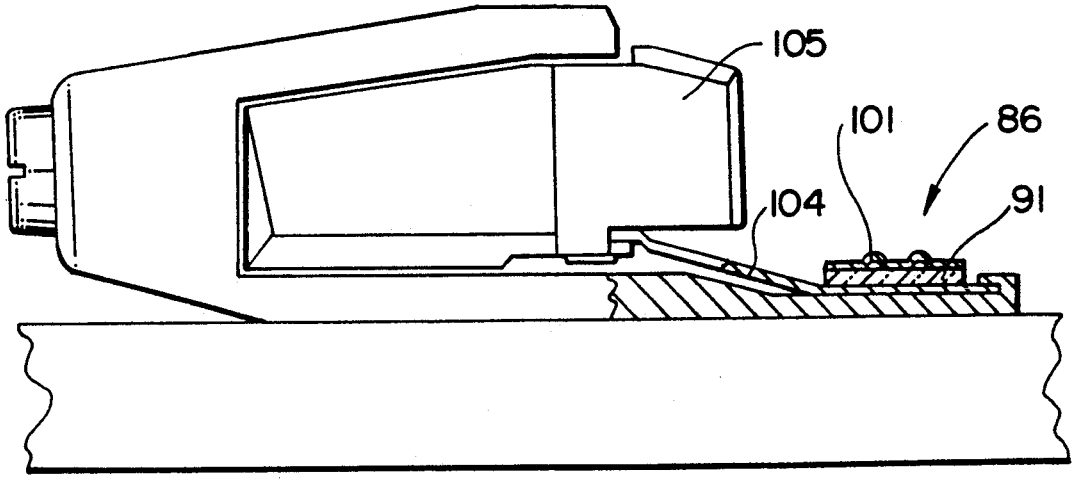

FIG. 9 is another variation according to which shock absorbing layer 91 is located above plate 104 mobile with jaw 105, and such layer 91 is moreover overhung with a support plate 101 on which the boot rests.

FIG. 10 represents a constructional variation of the plate of FIGS. 1–4, wherein the support plate on which the boot rests is constituted by a plurality of cylindrical sections 109 that are embedded in shock absorbing layer 116. The sections 109 are oriented in a substantially transverse direction and they are located in a substantially horizontal plane. Along the transverse direction, sections 109 are rectilinear, or slightly curved, the center of curvature being located in the heel zone of the boot.

FIG. 11 represents, in a vertical and transverse section, a ski 142. Ski 142 has, at the level of its upper surface, at least in the zone of the front binding, a rib 145, having a width that is smaller than the width of the ski, in a such a way that two recesses 146 and 147 are present on each side of rib 145. The layer of shock absorbing material is constituted of two segments 149 and 150, respectively located in each of recesses 146 and 147. Support plate 143 has a bridge shape, with two plates 153 and 154 respectively bearing on each of segments 149 and 150. Support plate 143 is overhung with a slide pad 144.

The height of each plate 153, 154, increased by the height of one segment 149, 150, is substantially greater than the height of rib 145 of the ski. Moreover, these heights can be determined in such a way, for example, that the upper surface of the ski 156 constitutes an abutment for support plate 143, which limits the vertical downward movement of support plate 143.

FIG. 12 represents a ski 160, whose transverse section is U-shaped, at least in the zone located at the rear of the front binding. The layer of shock absorbing material 161 is located inside the U-shaped section, and it is embedded between the two lateral edges 162 and 163 of ski 160. The support plate 165 and the slide pad 166 are located above the layer of shock absorbing material 161. The height of this layer 161 is greater than the depth of recess 167 of the ski. It can be determined in such a way that the upper surfaces of the two lateral edges 162 and 163 constitute an abutment that limits the downward vertical movement of support plate 165.

FIG. 13 represents another variation of a ski 170, whose section is U-shaped, at least at the rear of the front binding.

The layer of shock absorbing material 171 is embedded in recess 172 of the ski and has a height that is less than the depth of recess 172.

The layer 171 is overhung with the support plate 173, which, in its lower portion, has dimensions that enable it to penetrate into recess 172. As in the previous case, one can provide edges 174 of support plate 173 which, after a determined compression of layer 171, come into support on the lateral edges 175 that border recess 172.

Figure 14:
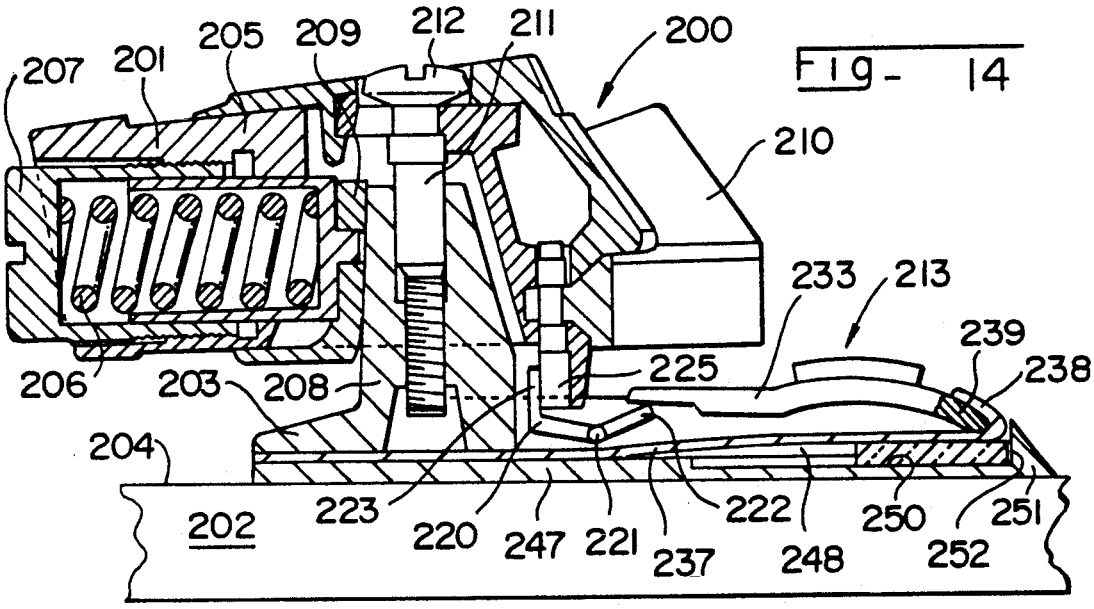
FIG. 14 represents, in a side sectional view, a front binding equipped with a contact plate, according to another embodiment of the invention.

FIG. 14 represents a binding 200 which is mounted on the upper surface 204 of a ski 202. Binding 200 is of a known type, for example, as described in French Patent Application No. 81.22577.

The embodiment represented comprises a pivot 203, affixed to ski 202. A body 205 is journalled with respect to pivot 203 about one or the other of the two converging support lines that the pivot has on its rear side, corresponding to the right side of the figure.

A return spring 206 is housed inside the body. Such spring 206 takes support at the level of its front end against a threaded stopper 207 that is screwed in a threaded opening of the body, and that enables the adjustment of the initial stress of the spring in the resting position. In the area of its rear end spring 206 is in support against the front surface 208 of pivot 203 by means of a support element 209.

A jaw 210, in which the front end of the sole of the boot is engaged, constitutes with the body, an integral assembly. A screw 211, substantially vertical, and screwed in pivot 203, enables the height of body 205 and of jaw 210 to be adjusted. Body 205 is, in fact, coupled to screw 211 in the area of its head 212 for all vertical movements of such head.

Body 205 and jaw 210 can pivot laterally under the lateral biases of the boot and against the return action of spring 206 that tends to bring back jaw 210 in the resting position, i.e., centered on the longitudinal axis of the ski. Body 205 and jaw 210 can also pivot in a limited manner in a vertical plane about head 212 of screw 211. This movement occurs against the return action of spring 206 and also results in a reduction of the force that the boot must overcome to laterally push back the jaw, if necessary, until the boot is released by the jaw.

Binding 200 also comprises a compensating mechanism. This compensating mechanism is of a known type, as described, for example, in French Patent Application No. 82.20852. It comprises a sensor 213 on which the front end of the sole of the boot rests. This sensor 213 constitutes the contact plate of the boot. Preferably, the upper surface of sensor 213 is coated with a plate of anti-friction material, such as, for example, of polytetrafluoroethylene, on which the sole of the boot rests.

Sensor 213 comprises a support plate 233 carried by a base 237 constituted, for example, by a fine metallic plate. The front portion of base 237 is held in a sandwich configuration between pivot 203 and upper surface 204 of the ski. The rear portion 238 of base 237 is folded back on rear edge 239 of support plate 233. This assembly constitutes a type of transverse journal and enables support plate 233 to pivot with respect to this zone about a transverse axis.

In the front zone of the sensor, a lever 220 with two arms is located, which is journalled with respect to base 237 about a transverse axis 221. The rear arm 222 of lever 220 extends rearwardly and upwardly from axis 221. The front edge of plate 233 is in support on the rear end of arm 222. The front arm 223 of lever 220 has, in a sectional plan view of the figure, the shape of a horseshoe, with a horizontal portion originating from the axis 221 in support on base 217, then a vertical portion. The upper end of this vertical portion is in support against the lower end of a substantially vertical nail 225, which is anchored in the lower portion of jaw 210.

In a known manner, under the effect of a downward, vertical force exerted by the boot on sensor 213, support plate 233 pivots about its rear edge 239 resulting in a rocking of lever 220 in a clock-wise direction, such rocking in turn resulting in a rocking of body 205 and of jaw 210 about the head of screw 212, in a counter-clockwise direction.

As mentioned above, such a vertical movement of the body reduces the force that the boot has to overcome in order to make its binding pivot laterally, and to be released, if necessary. This reduction compensates the increase in rubbing between the boot and the ski which is induced by this vertical downward force.

Figure 15:
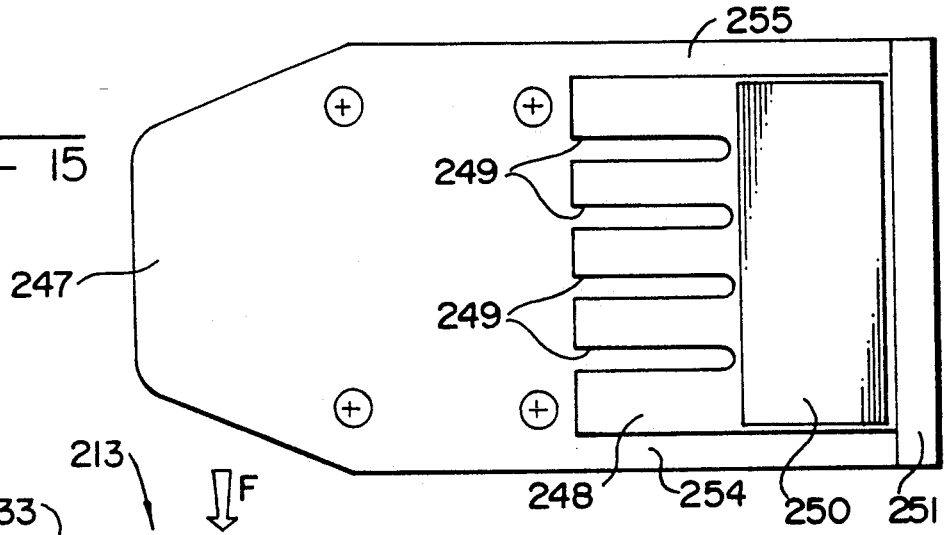
FIG. 15 represents a top view of the contact plate of FIG. 14, without the sensor.

A plate 247 is however inserted between base 237 and the upper surface 204 of ski 202. Plate 247 is, for example, affixed to the ski by screws that retain the pivot 203 to the ski. In its rear portion, in the zone of the sensor 213, plate 247 has a recess 248. A layer of shock-absorbing material 250 extends inside such recess 248. Preferably, this layer extends in the rear portion of recess 248, at least in the rear edge zone 239 of sensor 213. FIG. 15 represents ribs 249 in housing 248. These ribs ensure that layer 250 is maintained in position.

The thickness of layer 250 is greater than the depth of recess 248. In this way, base 237 is substantially prestressed towards the top by layer 250.

In a preferred embodiment, immediately behind fold 238, plate 247 has an edge 251, whose substantially vertical frontal surface 252 constitutes a support for the rear portion of layer 250.

Also, in a preferred embodiment, recess 248 is extended laterally by two edges 254 and 255, on which base 237 comes to rest beyond a determined compression of layer 250.

Figure 16:
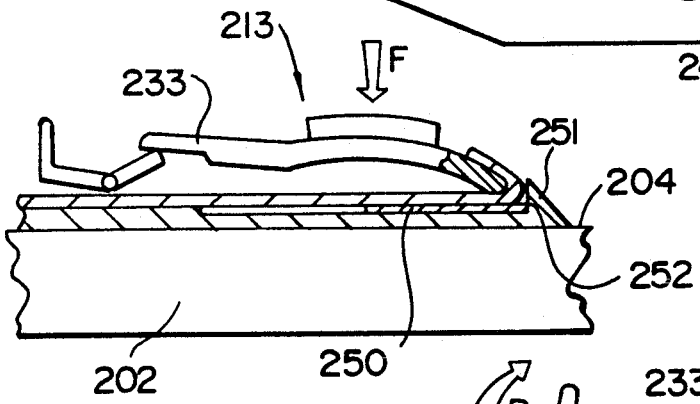
FIGS. 16 and 17 are partial sectional side views illustrating the functioning of the contact plate of FIG. 15.

FIG. 16 illustrates the functioning of the compensation mechanism. In this figure, the boot exerts a force F relative to the ski by means of a sensor 213, and it is assumed that the energy resulting from this force is integrally absorbed by the layer of material 250. This layer is flattened until base 237 comes into contact with edges 254 and 255 of plate 247. Additionally, layer 250 is retained in its rear portion by the vertical surface 252 of edge 251. Because of this, material 250 mainly acts in compression, and not much during shearing. Thus, advantageous damping characteristics are obtained. These characteristics can be modified by varying the distance between surface 252 and the rear portion of layer 250.

Figure 17:
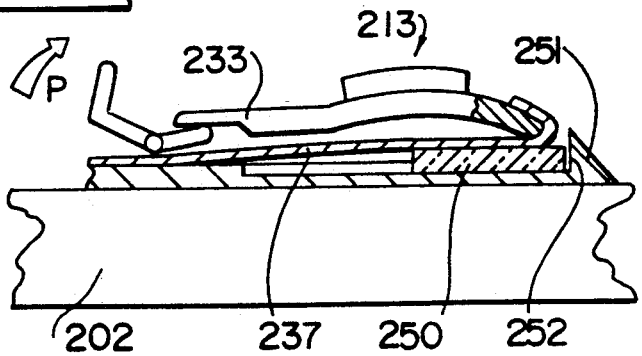

In FIG. 17, it is assumed, also to facilitate understanding, that the boot exerts a force P relative to the ski by means of sensor 213, such force having no effect on the layer of shock absorbing material 250, and which is entirely transmitted to lever 220. In this case, support plate 233 rocks about the rear edge 239 of sensor 213, resulting in a clock-wise pivoting of lever 220, and an upward rocking of jaw 210, as has been described hereinabove.

In practice, according to the nature of the biases exerted by the boot relative to the ski, the functioning of the compensation mechanism is a combination of the two modes of functioning described with respect to FIGS. 16 and 17. Thus, the biases that exist between the boot and the ski along a vertical direction are either absorbed by the layer of shock-absorbing material 250, or else are transmitted to lever 220.

Since the filtering means and the compensation means function independently, a bias of the boot relative to the ski can either be absorbed and filtered by layer 250, or else can be transmitted to lever 220, or again, can be partially filtered and partially transmitted to lever 220.

The present description is only given as an example, and other embodiments and implementations of the invention can be adopted without exceeding the spirit of this invention.

We claim:

1. A safety ski binding for retaining a front end of a ski boot on a ski and for releasing the front end of the ski boot from the ski under a predeterminate force, said binding comprising:

(a) a base to be affixed to an upper surface of the ski;

(b) a retention element for engagement with a portion of the front end of the ski boot, said retention element being mounted for movement with respect to said base;

(c) means for biasing the retention element with a predeterminate biasing force against a releasing movement of the front end of the ski boot;

(d) a compensating mechanism comprising means for reducing said predeterminate biasing force is response to a downward force exerted by the ski boot, said compensating mechanism further comprising:

(i) a support element to be positioned between the boot and the ski and for supporting a front portion of a sole of the boot, said support element comprising a sensor having a support surface for engagement with the sole of the boot; and (ii) means for mounting said support element to said base for vertical movement in response to the downward force exerted by the ski boot; and (e) a quantity of shock-absorbing material positioned below and mounted to said base and above the upper surface of the ski for filtering vibrations transmitted by the ski to the ski boot and for absorbing stresses between the ski boot and the ski, while maintaining functioning of said compensating mechanism.

2. A safety ski binding according to claim 1, further comprising:

a plate upon which said base is supported, said plate adapted to be supported upon the upper surface of the ski, wherein:

said plate comprises a forward portion and a rearward portion, said sensor being positioned above said rearward portion of said plate; and said quantity of shock-absorbing material being located between said base and said plate above said rearward portion of said plate.

3. A safety ski binding according to claim 2, wherein said plate further comprises:

means defining a recess for containing said quantity of shock-absorbing material, said quantity of shock-absorbing material having a predetermined thickness and said recess having a depth less than said thickness of said quantity of shock-absorbing material; and opposite edges bordering said recess, said opposite edges constituting vertical abutments for said base.

* * * * *